United States Patent [19]

Wurst

[11] 4,131,075

[45] Dec. 26, 1978

[54] SPEED LIMITER FOR PATTERN STITCH SEWING MACHINE

[75] Inventor: John W. Wurst, Dover, N.J.

[73] Assignee: The Singer Company, New York, N.Y.

[21] Appl. No.: 846,969

[22] Filed: Oct. 31, 1977

[51] Int. Cl.[2] ..... D05B 3/02; D05B 69/36

[52] U.S. Cl. ..... 112/158 E; 112/277

[58] Field of Search ..... 112/277, 158 E, 121.11, 112/220, 221; 318/246, 345 G, 345 F

[56] References Cited

U.S. PATENT DOCUMENTS

| | | | |
|---|---|---|---|
| 3,074,632 | 1/1963 | Braun et al. | 112/121.11 X |
| 3,302,088 | 1/1967 | Wigington | 112/277 X |
| 3,872,808 | 3/1975 | Wurst | 112/121.11 |
| 3,965,830 | 6/1976 | Dorosz | 112/121.11 |

FOREIGN PATENT DOCUMENTS

| | | | |
|---|---|---|---|
| 2649923 | 5/1977 | Fed. Rep. of Germany | 112/277 |
| 2702488 | 7/1977 | Fed. Rep. of Germany | 112/158 E |

*Primary Examiner*—Peter Nerbun
*Attorney, Agent, or Firm*—David L. Davis; Edward L. Bell; Robert E. Smith

[57] ABSTRACT

A sewing machine is disclosed wherein positioning of the work feeding mechanism and/or needle is controlled by a respective actuator responsive to stitch pattern signals applied thereto. To enable the actuator to complete its positioning for the next stitch prior to repenetration of the needle, the power supplied to the main drive motor of the sewing machine is interrupted until the actuator has completed its task.

6 Claims, 3 Drawing Figures

SPEED LIMITER FOR PATTERN STITCH SEWING MACHINE

BACKGROUND OF THE INVENTION

This invention relates to sewing machines and, more particularly, to sewing machines utilizing stitch pattern signal responsive actuators for positioning the needle and/or the work feeding mechanism between successive stitches of a predetermined pattern.

Sewing machines which automatically stitch a preselected pattern are well known and have been in use for a number of years. In the past, these machines have typically been operated by providing a selected pattern cam for controlling the positioning of the needle and/or the work feeding mechanism in accordance with a desired pattern of stitches. Such cams are operatively connected to the main drive motor of the machine and hence there is an inherent synchronization between the positioning mechanism and the penetrations by the needle to form the stitches. However, with the advent of electronically controlled sewing machines, the pattern cams have been replaced by actuators responsive to stitch pattern signals stored in a memory. Insofar as speed of operation is concerned, these actuators operate imdependently from the main drive motor of the machine and hence a problem can arise if the operation of the actuator is not completed prior to repenetration of the needle. Typically, these actuators operate at a fixed speed. Therefore, the time it takes to position the needle and/or the work feeding mechanism is dependent upon the distance that must be traversed. Since the positioning must be complete between successive needle penetrations, as the stitch rate of the machine increases, less time is available for the positioning. In a machine utilizing stepping motors as the actuators, the required positioning time may be greater than is available, based on the rotational speed called for by the machine operator. When this situation occurs, patterning errors can result, for example, zig-zag width may decrease as the sewing speed increases, and the stepping motor may even be pulled out of pole orientation.

It is therefore an object of this invention to insure sufficient time for the actuator to reposition the bight or feed mechanism.

SUMMARY OF THE INVENTION

The foregoing and additional objects are attained in accordance with the principles of this invention by providing a sewing machine having a stitch forming instrumentality variable in position over a predetermined range of positions between successive stitches to produce a pattern of stitches, a driving device operatively connected to impart movement to said stitch forming instrumentality over said predetermined range of positions in response to stitch pattern signals applied thereto, a drive motor coupled to move said stitch forming instrumentality so as to form stitches, means for supplying power to said drive motor, and means for interrupting the supply of power to said drive motor during operation of said driving device.

DESCRIPTION OF THE DRAWINGS

The foregoing will be more readily apparent upon reading the following description in conjunction with the drawings in which.

DETAILED DESCRIPTION OF THE PREFERRED EMBODIMENT

Figure 1:
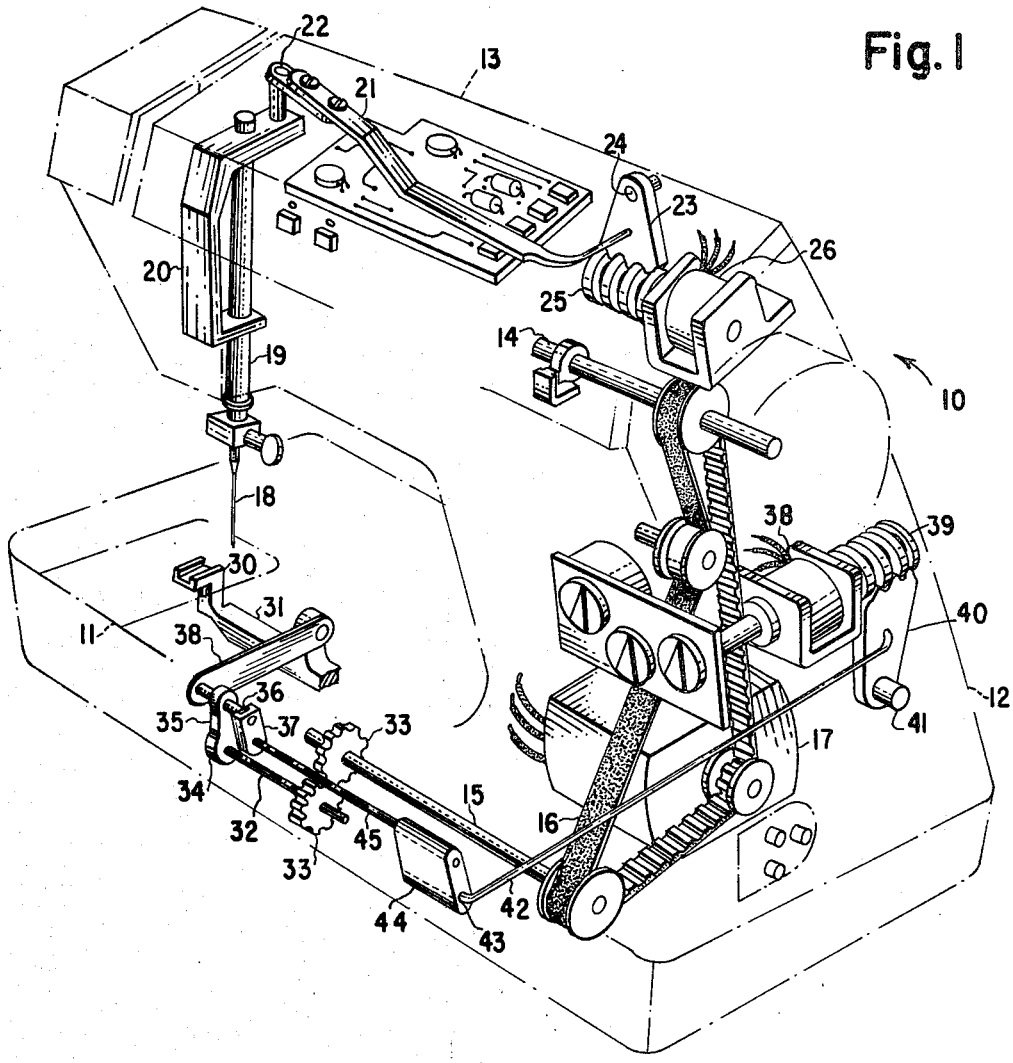
FIG. 1 is a perspective view of a sewing machine including fragments of a typical driving mechanism and of sewing needle and work feeding mechanisms controlled by respective stepping motors and which forms an environment for an arrangement constructed in accordance with the principles of this invention.

FIG. 1 of the drawings illustrates a sewing machine with fragments of two mechanisms shown thereon, the needle and the work feeding mechanism, which can contribute to changes in the relative coordinates of successive needle penetrations. As shown in phantom lines in FIG. 1, the sewing machine casing 10 includes a bed 11, a standard 12 rising from the bed and a bracket arm 13 overhanging the bed. The driving mechanism of the sewing machine includes an arm shaft 14 and a bed shaft 15 interconnected by a timing belt 16 in the standard. Timing belt 16 is driven by main drive motor 17. A needle 18 carried for endwise reciprocation by a needle bar 19 is mounted for lateral jogging movement in a gate 20 in the bracket arm 13. Any conventional connections (not shown) may be used between the arm shaft and the needle bar for imparting needle reciprocation. A drive link 21 pivoted at 22 to the gate 20 serves to impart lateral jogging movement to the needle 18. Drive link 21 is connected to gear segment 23 which is pivoted at 24. Gear segment 23 is meshed with worm 25 which is an extension of the shaft of stepping motor 26. Rotation of stepping motor 26 causes rotation of worm 25 and the consequent pivoting of worm gear segment 23, which controls the position of link 21 and hence the lateral position of needle 18.

Also illustrated in FIG. 1 is a fragment of a work feeding mechanism including a feed dog 30 carried by a feed bar 31. In FIG. 1 a mechanism is illustrated for imparting work transporting movement to the feed dog 30 including a feed drive shaft 32 driven by gears 33 from the bed shaft 15, a cam 34 on the feed drive shaft 32, a pitman 35 embracing the cam 34 and connected to reciprocate a slide block 36 in a slotted feed regulating guideway 37. A link 38 pivotally connects the pitman 35 with the feed bar 31 so that depending upon the inclination of the guideway 37, the magnitude and direction of the feed stroke of the feed dog 30 will be determined. The inclination of the guideway 37 is controlled by stepping motor 38, a worm 39 being an extension of the shaft of stepping motor 38. Meshed with worm 39 is worm gear segment 40 pivoted at 41. Connected to the worm gear segment 40 is a link 42 pivoted at 43 to a rock arm 44 carried on a rock shaft 45 secured to the guideway 37. Rotation of the stepping motor 38 causes rotation of the worm 39 and the consequent pivoting of the worm gear segment 40, which controls the position of the link 42 and the inclination of the guideway 37.

Figure 2:
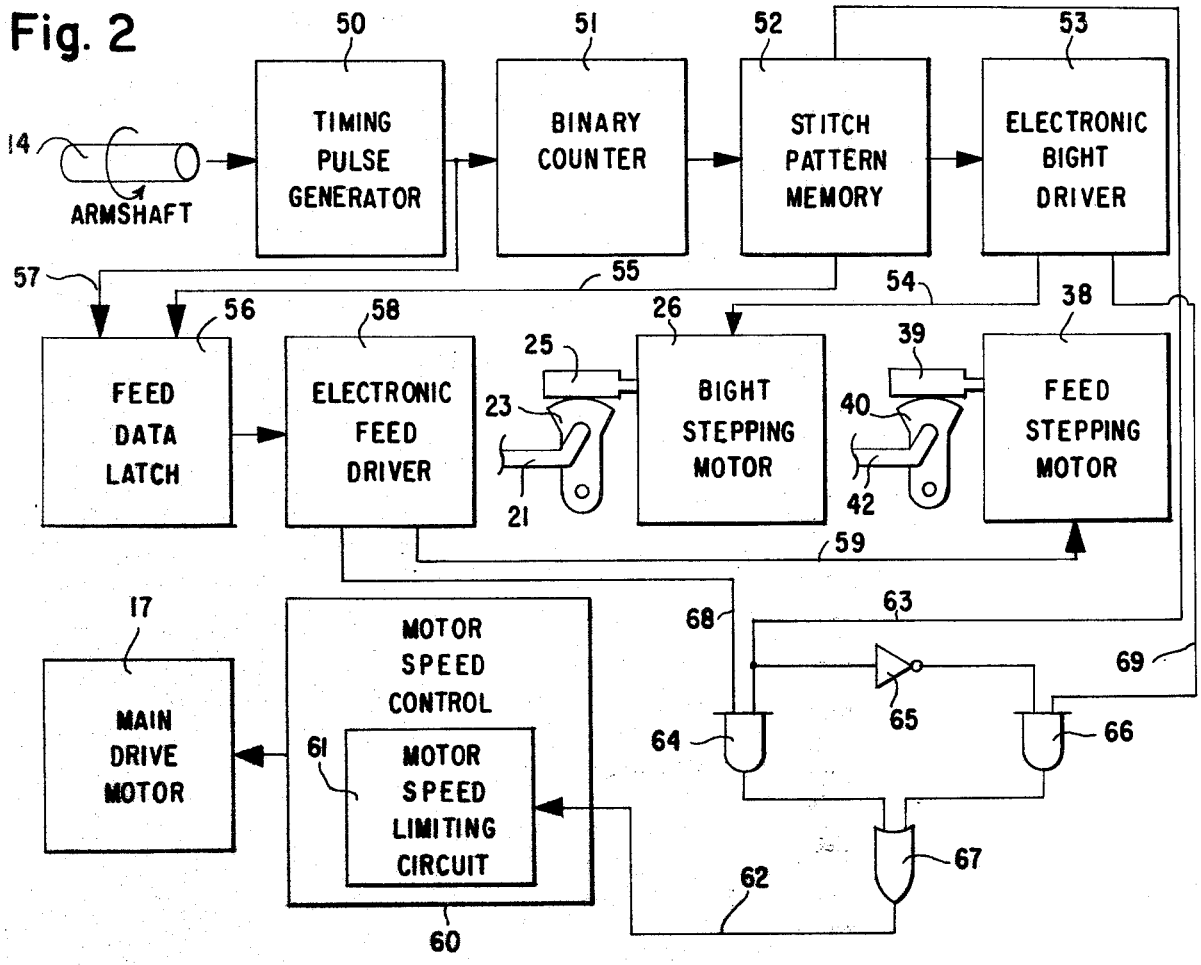
FIG. 2 is a block diagram of an illustrative control system for the sewing machine shown in FIG. 1, which control system incorporates the principles of this invention.

Referring now to FIG. 2, depicted therein is a block diagram of an illustrative control system for the sewing machine shown in FIG. 1, which control system incorporates the principles of this invention. Only as much detail will be given as is necessary for an understanding of the present invention.

The sewing machine arm shaft 14 is connected to drive a pulse generator 50 which may preferably be of the type shown and described in U.S. Pat. No. 3,939,372. The pulse generator 50 provides a single timing pulse for each rotation of the arm shaft 14 and applies this pulse to a binary counter 51. Illustratively, the binary counter 51 is a five bit binary counter arranged to count to 31 and reset to zero on the following pulse. Thus, a pattern having 32 needle penetrations may be repeated indefinitely without special provision for resetting the counter to zero. The output of the counter 51 is presented as the input address to a memory 52 in which is stored the bight and feed information for the desired stitch pattern. The bight information output from the memory 52 is presented directly to a bight driver 53 which, in a conventional manner, provides signals on leads 54 to control the bight stepping motor 26. However, since in a sewing machine the response to changes in bight and feed pattern information between successive stitches cannot occur at the same time in the arm shaft cycle and, in general, these functions should occur approximately 180° apart in the arm shaft cycle, the feed information from the memory 52 is held on an input line 55 of a latch 56 until the occurrence of a latch signal on a lead 57. Illustratively, the latch signal on the lead 57 may be the trailing edge of a 50 percent duty cycle timing pulse from the pulse generator 50. At this time, the feed information on the lead 55 is presented to a feed driver 58 which, also in a conventional manner, provides signals on the leads 59 to control the feed stepping motor 38.

As has been mentioned above, the stepping motors 26 and 38 must assume their new positions between successive needle penetrations. The time available for such positioning is determined by the machine operator controlling the speed of the main drive motor 17 through a motor speed control 60. In accordance with the principles of this invention, there is provided within the motor speed control 60 a motor speed limiting circuit 61. When a signal is applied to the motor speed limiting circuit 61 over a lead 62, in a manner to be described hereinafter, the power to the main drive motor 17 is interrupted. This does not cause the motor 17 to stop. Instead, since no power is applied to the motor 17, it slows down sufficiently so that the stepping motors 26 and 38 can complete the positioning of their respective mechanisms.

The control signal on the lead 62 may be derived in any one of a variety of ways depending upon stepping motor speed, the complexity of the pattern being sewn, and drive and control inertias. For example, the signal on the lead 62 might be present whenever a stepping motor is moving, or whenever a stepping motor is moving and has eight steps or more yet to move. When sewing a pattern where both the bight and the feed are controlled, since the bight and feed controls take place at different times, it may be desirable for only one of the two functions to determine the speed limiting control signal. The controlling function could depend upon the particular pattern and whether the bight or the feed has greater excursions within that pattern. A particular bit position within the memory 52 could indicate whether the bight or feed function is controlling. Illustratively, this bit position would be outputted on a line 63 and applied to an AND gate 64. The bit would also be inverted by an inverter 65 and applied to an AND gate 66. The other input to the AND gate 64 would be from the feed driver 58 and the other input to the AND gate 66 would be from the bight driver 53. The outputs of the AND gates 64 and 66 would be applied to an OR gate 67 whose output would be the control signal on the lead 62. The inputs to the AND gates 64 and 66 on the leads 68 and 69 from the respective feed and bight drivers 58 and 53 are generated in a conventional manner to logically indicate, for example, when the respective stepping motor is moving. Alternatively, the signals on leads 68 and 69 could indicate that, for example, the respective stepping motor has eight or more steps yet to move. Thus, the speed limiting control signal may be generated in a desired manner as a function of either the bight or feed motion.

Figure 3:
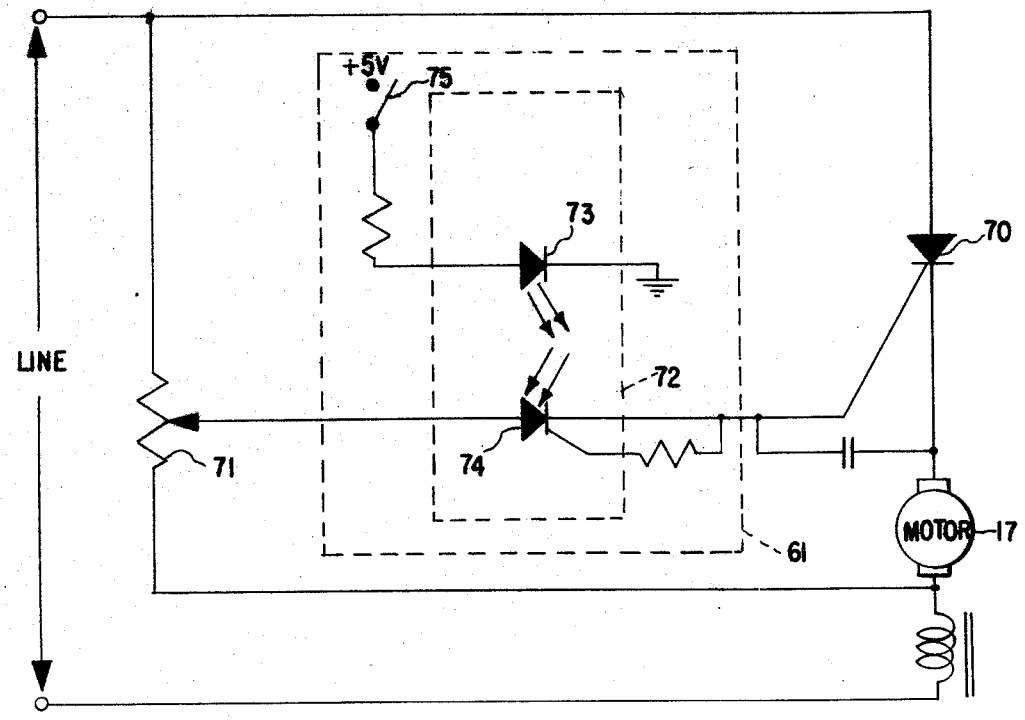
FIG. 3 is a detailed schematic circuit diagram of a portion of the control system of FIG. 2 depicting details of an embodiment of this invention.

Referring now to FIG. 3, depicted therein is an illustrative motor speed control circuit incorporating therein a motor speed limiting circuit in accordance with the principles of this invention. The circuitry shown in FIG. 3 is connected to standard commercially available line power. The speed of the motor 17 is controlled in a conventional manner by varying the conductivity time of an SCR 70, connected in series with the motor 17. This control is effected through operator control of a potentiometer 71. In accordance with the principles of this invention, interposed between the potentiometer 71 and the gate of the SCR 70 is the motor speed limiting circuit 61, illustratively including an opto-electronic package 72. The opto-electronic package 72 includes a light emitting diode 73 optically coupled to a photoresponsive SCR 74. When current passes through the light emitting diode 73, it generates light, which causes the SCR 74 to be turned on, allowing the SCR 70 to be triggered. When no current flows through the light emitting diode 73, the SCR 74 is nonconductive, inhibiting the triggering of the SCR 70. The flow of current through the light emitting diode 73 is controlled in a conventional manner by the signal on the lead 62 (FIG. 2), schematically depicted as a switch 75. With the switch 75 in the open position, no current flows through the light emitting diode 73 and hence the power to the motor 17 is interrupted. With the switch 75 in its closed position, power may be supplied to the motor 17 in accordance with the operator controlled setting of the potentiometer 71.

Accordingly, there has been described an arrangement in a sewing machine utilizing stitch pattern signal responsive actuators for positioning the needle and/or the work feeding mechanism between successive stitches of a predetermined pattern to insure sufficient time for the actuators to reposition their respective mechanisms. It is understood that the above-described arrangement is merely illustrative of the application of the principles of this invention. Numerous other arrangements may be devised by those skilled in the art without departing from the spirit and scope of this invention, as defined by the appended claims. For example, while an opto-electronic package has been shown for interrupting SCR gate current, it is contemplated that any equivalent controllable switching device, such as a relay for example, may be utilized while still remaining within the scope of this invention.

Having thus set forth the nature of the invention, what is claimed herein is:

1. In a sewing machine having a stitch forming instrumentality variable in position over a predetermined range of positions between successive stitches to produce a pattern of stitches, driving means operatively connected for imparting movement to said stitch forming instrumentality over said predetermined range of positions in response to stitch pattern signals applied thereto, a drive motor coupled to move said stitch forming instrumentality so as to form stitches, means for supplying power to said drive motor, and means for interrupting the supply of power to said drive motor during operation of said driving means.

2. The sewing machine according to claim 1 wherein said power supplying means includes a silicon controlled rectifier serially connected to said drive motor and said interrupting means includes means for selectively opening the gate circuit of said silicon controlled rectifier.

3. The sewing machine according to claim 2 wherein said gate opening means includes a light responsive switching element coupled to said gate and means for selectively supplying light to said switching element.

4. The sewing machine according to claim 3 wherein said light responsive switching element comprises a photosensitive silicon controlled rectifier and said means for selectively supplying light includes a light emitting diode.

5. The sewing machine according to claim 4 further including means for generating a control signal responsive to operation of said driving means and means utilizing said control signal for selectively passing current through said light emitting diode during operation of said driving means.

6. The sewing machine according to claim 1 wherein said stitch forming instrumentality includes a laterally jogable needle for forming zig-zag stitches of variable bight and a work feeding mechanism, and said driving means includes a first stepping motor for positioning said needle and a second stepping motor for positioning said work feeding mechanism, said sewing machine further including means for generating a first signal indicative of movement of said first stepping motor, means for generating a second signal indicative of movement of said second motor, and means for selectively applying either said first or said second signal to said interrupting means.

* * * * *